US005485946A

United States Patent [19]

Jankel

[11] Patent Number: 5,485,946

[45] Date of Patent: Jan. 23, 1996

[54] RELEASE LOCKING MEANS OF A DRIVING TOOL FOR FASTENERS

[75] Inventor: Bernd Jankel, Ahrensburg, Germany

[73] Assignee: Joh. Friedrich Behrens AB, Ahrensburg, Germany

[21] Appl. No.: 237,206

[22] Filed: Apr. 15, 1994

[30] Foreign Application Priority Data

Apr. 16, 1993 [DE] Germany ..... 9305760 U

[51] Int. Cl.[6] ..... B25C 1/04

[52] U.S. Cl. ..... 227/8; 227/130

[58] Field of Search ..... 227/8, 120, 130

[56] References Cited

U.S. PATENT DOCUMENTS

| | | | |
|---|---|---|---|
| 3,011,169 | 12/1961 | Cast et al. . | |
| 3,612,379 | 10/1971 | Panock | 227/8 |
| 3,677,457 | 7/1972 | Ramspeck et al. | 227/8 |
| 3,784,077 | 1/1974 | Burke, Jr. et al. . | |
| 3,948,426 | 4/1976 | LaPointe . | |
| 4,351,464 | 9/1982 | Fehrs et al. | 227/8 |
| 4,378,084 | 3/1983 | Scala | 227/8 |
| 4,597,517 | 7/1986 | Wagdy . | |
| 4,629,106 | 12/1986 | Howard et al. . | |
| 5,137,197 | 8/1992 | Bauer . | |
| 5,193,730 | 3/1993 | Tanaka et al. | 227/8 |

FOREIGN PATENT DOCUMENTS

| | | |
|---|---|---|
| 2601836 | 7/1977 | Germany . |
| 3021884 | 1/1981 | Germany . |
| 3703753 | 8/1988 | Germany . |
| 8810753 | 12/1988 | Germany . |

*Primary Examiner*—Scott A. Smith
*Attorney, Agent, or Firm*—Vidas, Arrett & Steinkraus

[57] ABSTRACT

A pneumatically operated driving tool having an improved release locking function having a working cylinder, a drive-in tappet mounted on the working piston, a control valve array for moving the piston to the lower dead center and to the upper dead center, and a piston return chamber which is connected to the working cylinder via a first opening adjacent to the lower dead center and via a second opening spaced apart from the lower dead center. The driving tool further includes a mouth tool having a drive-in channel, a magazine having an opening adjacent to the mouth tool, a sensor comprising a slidable sensor head, a sensor slide portion connected to the sensor head and an abutment portion extending transversely to the sensor slide portion's direction of displacement. The driving tool further includes a trigger lever for displacing the valve rod, having a pivotally mounted valve lever as well as a control lever mounted thereon, wherein the free end of the control lever end is supported by the abutment portion before actuation of the sensor and before actuation of the trigger lever, and wherein the control lever end remains supported by the abutment portion after actuating the sensor. When the trigger lever is actuated, so that the control lever actuates the valve rod, the free end of the control lever slips from the abutment portion until the sensor, which locks when actuating the valve rod and unlocks when releasing the valve rod, is reactivated so that the valve rod is not further displaced by the trigger lever.

10 Claims, 8 Drawing Sheets

1
2
3
4
5
6
7
8
11
14
17
20
36
37
44
46
49
50
52
57

RELEASE LOCKING MEANS OF A DRIVING TOOL FOR FASTENERS

FIELD OF THE INVENTION

It is the object of the invention to provide a release locking means on a pneumatically operated tool for driving in fasteners according to the preamble of claim 1.

BACKGROUND

The invention relates to driving tools which all of a sudden drive a fastener into a workpiece. The drive-in pulse is triggered by a piston which carries out a working stroke when suddenly being subjected to compressed air. Thereat high impact forces go into effect which sling a fastener over a large distance if the tool is not provided with a mouth tool located on the workpiece. A danger to persons caused by fasteners flying around is avoided by the provision of release locking means which today are prescribed for driving tools. The outlet of the mouth tool is provided with a sensor head which is actuated when the driving tool is placed upon the workpiece. A drive-in operation can be triggered by releasing a finger-actuated triggering means only after having actuated the sensor head.

The DE-AS 26 01 836 discloses a release locking means provided on a driving tool wherein the control valve arrangement for the piston movement comprises a valve rod, the actuation of which triggers a working stroke and the release of which triggers a return stroke of the working piston. To the one end of the valve rod a finger-actuated releasing means is associated which comprises a valve lever pivotally mounted on a tool case. At the free end of the valve lever a control lever is pivotally mounted which below the pivot pin of the valve lever comprises a free control lever end. The free control lever end of the vertically adjusted tool is supported on a supporting portion of a sensor slide portion which is connected to the sensor head. When the sensor head is actuated by being placed upon a workpiece, the sensor slide portion with the supported end of the pivoted lever is displaced towards the pivot pin of the valve lever. A subsequent actuation of the releasing means by pivoting the valve lever causes the control lever to engage the valve rod and displace it by its stroke of actuation. Hereby the drive-in operation is triggered. If, however, the mouth tool with the sensor head does not engage the workpiece the sensor slide portion is displaced to a lower portion by the influence of gravity. The pivoted lever supported thereon does not get into contact with the valve rod when tilting the valve lever. Consequently, in this driving tool triggering of a drive-in operation without actuation of the sensor head is not possible.

In practice, the known driving tool has the disadvantage that the drive-in operation can also be triggered by placing the sensor head upon a workpiece when, at the same time,the pivoted lever is actuated (so-called "touching"). For this reason, the trigger lever often is actuated continuously and the drive-in operation is controlled exclusively by placing the sensor head upon the workpiece. This may result in dangerous false triggerings in case the sensor head is actuated by an unintended touch resp. acceleration and, in this way, a shot is triggered. According to the currently operative rules, such a simple locking means is no longer admissible for all fields of application.

In a further developed locking means the control lever is placed upon the abutment portion of the sensor slide portion with a short end portion only. The control lever is supported on the valve rod by means of a pressure spring, and by a pneumatic piston supported by a spring the sensor or slide portion is retained in a lower position while being inoperative. When actuating the sensor head the sensor slide portion is lifted with the control lever end against the force acting upon the pneumatic piston. A subsequent actuation off the valve lever results in an actuation of the valve rod by means of the control lever and triggers the drive-in operation. If, however, the valve lever is pivoted with the sensor head being in an inoperative condition, the free end of the control lever slips from the abutment portion and moves beside the sensor slide portion. There the end is stopped by the engagement of a surface being connected to the case without being raised at a pivotal movement of the valve lever. Consequently, the control lever does not get into contact with the valve rod and cannot trigger any drive-in operation. A triggering without previous actuation of the sensing means, therefore, is not possible. The user cannot control the drive-in operation by merely placing the mouth tool upon the workpiece. The use of this driving tool, however, frequently results in any malfunctions. After termination of a drive-in operation there often cannot be enabled a further triggering by merely actuating the trigger lever. The same holds true if the tool is drawn off the workpiece with the trigger lever being actuated. In that case the tool needs to be removed from the workpiece, the trigger lever to be released and reactuated for driving in another fastener.

SUMMARY

Taking these facts as a basis, it is the object of the invention to provide an improved release locking means for a driving tool for fasteners wherein each drive-in operation makes an actuation of the trigger lever necessary and wherein besides the actuation of the trigger lever no triggering preparations are required.

The invention is based upon the following knowledge of the return stroke effect-s during the drive-in operation. Due to the high drive-in force the driving tool can leave the workpiece for a short time, the resetting means causing the sensing means to return to its rest position. Thereat the trigger lever is actuated since the return stroke takes place fractions of seconds after triggering the drive-in operation. However, during the return movement of the sensor slide portion, the spring-actuated control lever may slip from the abutment portion and move beside the slide portion. When replacing the tool the slide portion moves past the side of the control lever end so that the latter is stopped on the portion being connected to the housing. If now the driving tool is displaced to a new drive-in position with outputting down the mouth tool the drive-in operation cannot be triggered by merely actuating the trigger lever. The free control lever end keeps up its lower position which does not allow an actuation of the valve rod during a pivoting movement of the valve lever. Another drive-in operation requires the lifting of the tool from the workpiece and the involved displacement of the sensor slide portion to the lower position. Furthermore, the user has to release the valve lever so that the free control lever end returns to the abutment portion of the sensor slide portion. Thereafter, the mouth tool needs to be put down which causes the free control lever end to take its raised position again. Finally, the shot can be triggered by actuating the trigger lever.

Accordingly, during the lifting of the mouth tool from the workpiece as a result of the return stroke, the main point is to prevent a return movement of the sensing means downwardly. Generally, it is to be avoided that the sensing means returns to its rest position when the driving tool is lifted from the workpiece with the valve rod being actuated which can be done arbitrarily by the user, too. Therefore, according to the invention, a locking means is associated to the sensing means which locks the sensing means in its operated position when actuating the valve rod and unlocks the sensing means again when releasing the valve rod. If, therefore, the actuation of the trigger lever has led to a drive-in operation, the sensing means is maintained in its operative position until the trigger lever is released again in preparation for a new drive-in operation. In this way, it is guaranteed that the free control lever end is kept in place on the abutment portion of the sensor slide portion. At the same time, it is guaranteed that another shot can only be triggered after actuation of the sensing means.

The locking means may comprise a locking piston within a locking cylinder connected to a sensing slide portion, a control line loading the locking piston with working pressure for a locking in the direction of actuation of the sensor slide portion and aerating it for unlocking. For this purpose, the control line may be connected to the piston return chamber to which during the working stroke of the piston a working pressure is applied and which is aerated after the return stroke of the piston. The flow resistance of the control line is so, adjusted that a sufficient working pressure is applied to the locking piston in time before the return stroke allows a return movement of the sensing means to its rest position.

For an early control of the locking piston the control line can be connected to the working cylinder via a third opening at a distance from the bottom dead center. According to another embodiment, provision is made for connecting the control line to an auxiliary valve on the valve rod allowing the locking to cooperate more closely with the actuation of the valve rod.

For resetting the sensing means to its rest position a pressure spring is provided preferably which acts upon the locking piston in the opposite direction of actuation of the sensor slide portion.

The sensor slide portion can comprise a recess being c-shaped in cross-section, the lower limitation of which forms the abutment portion for the control lever end while the upper limitation of which is connected to the locking piston. The so formed recess can also serve the accommodation of the pivot pin of the valve lever. Preferably, beside the sensor slide portion a stationary supporting portion for the free control lever end is arranged which is in alignment with the abutment portion before actuating the sensing means. As soon as the free control lever end slips fron the abutment portion it is kept by the supporting portion at a height which allows it to easily return to the abutment portion after releasing the trigger lever with the sensing means being unactuated.

Finally, according to a useful embodiment, provision is made for arranging a pressure spring between the control lever and the valve rod which pressure spring always keeps the control lever in a defined position. The pressure springs of the locking piston and the control lever together cause the driving tool to be used in any alignment towards the perpendicular.

BRIEF DESCRIPTION OF THE DRAWINGS

Further details and advantages of the invention do appear from the following description of the corresponding drawings showing preferred embodiments. The drawings show.

DETAILED DESCRIPTION OF THE INVENTION

Figure 1:
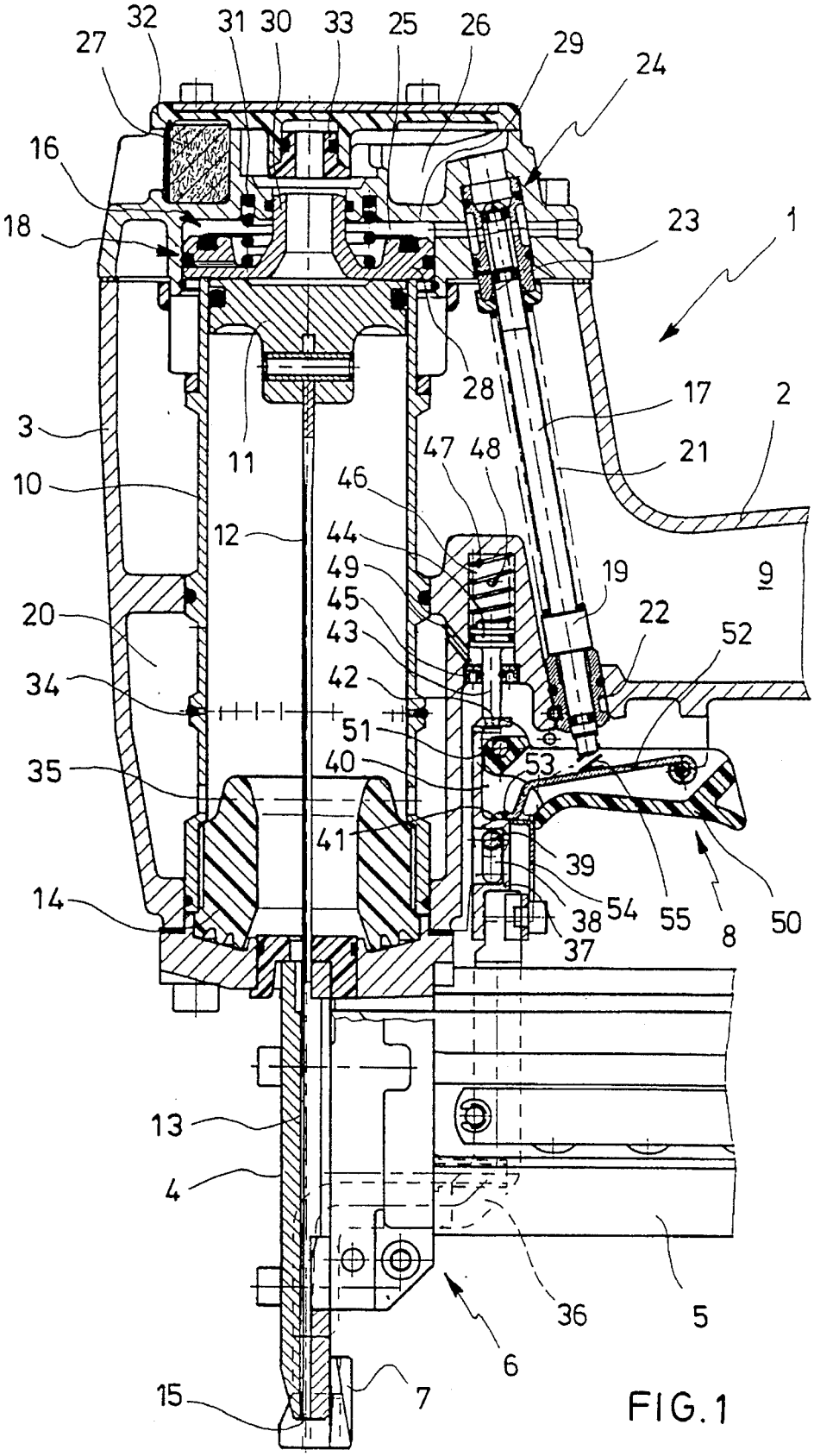
FIG. 1 a driving tool for clips, nails or suchlike with locking air from the piston return chamber in rest position and in longitudinal section across the front area.

In the following description of different embodiments identical components of the tool are provided with identical reference numbers. Accordingly, the description is valid for all embodiments.

All driving tools comprise a case 1 including a case handle 2 and a case head 3 at the front end. At the bottom of each working head there is secured a mouth tool 4. Fasteners are supplied from a magazine 5 to the mouth tool 4. Besides, a sensing means 6 is provided which with a sensor head 7 exceeds the lower end of the mouth tool 4. Finally, a pivotally located trigger lever for finger actuation is provided.

In the case handle 2 a compressed-air storage space 9 is provided which extends to an upper portion of the case head 3 and to which a compressed-air supply can be connected. In the case head 3 a working cylinder 10 is provided in which a worrying piston 11 is arranged. The working piston 11 at its lower end is connected to a drive-in tappet 12 which is guided within a drive-in channel 13 of the mouth tool 4. The magazine 5 supplies—through an opening not shown—to the drive-in channel 13 one fastener each. From its upper dead center the piston 11 can be moved to an elastic brake ring 14 in the lower dead center, in which case a fastener is driven into a workpiece. For this purpose, the drive-in channel 13 comprises an outlet 15 at the lower end of the mouth tool 4.

For the abrupt movement of the piston 11 from the upper to the lower dead center and for its back movement from the lower to the upper dead center a control valve array 16 is provided. This control valve array 16 basically comprises a valve rod 17 and a valve array 18 which is arranged above the working cylinder 10. The control valve array 16 serves the purpose of connecting the compressed-air storage space 9 to the working cylinder 10 above the working piston 11 when actuating the valve rod by axially displacing it upwardly in order to drive the working piston from the upper dead center to the lower dead center. Besides, the function of the control valve array 16 is to connect the working cylinder 10 above the working piston 11 to atmosphere when there is a back movement of the valve rod 17 downwardly to the point of engagement of its collar 19 with a stop so that any air below the working piston supplied by a piston return chamber 20 drives the working piston back from the lower to the upper dead center. The DE-AS 26 01 836 discloses a control valve array which shows this function and which is suitable for the realization of the invention. The control valve array according to the drawing is pertinent as prior art as well and, therefore, is explained hereinafter with respect to its most essential features only.

The valve rod 17 includes a reset spring 21 which causes the valve rod to return to its rest position after relief. At the bottom the valve rod 17 is led through a sealing sleeve 22 of the casing. At the top it forms an auxiliary valve 24 together with a sleeve 23. With the valve rod being unactuated (FIGS. 1, 3, 5) the auxiliary valve connects the compressed-air storage space 9 to a control space 25 above the working cylinder 10. With the valve rod 17 being actuated (FIGS. 2, 4, 7) the auxiliary valve 24 connects the control space 25 to atmosphere via an air outlet space 26 and filter 27.

The control space 25 is limited by a control piston 28 below and by a case wail 29 above. The case wall 29 comprises a sealing leadthrough for a tubular nose portion 30 of the control piston 19. Furthermore, a coil spring 31 is supported between the upper case wall 29 and the control piston 28. Finally, a sleeve-shaped valve seat element 33 is sealingly guided in a bore of a case cover 32.

Figure 2:
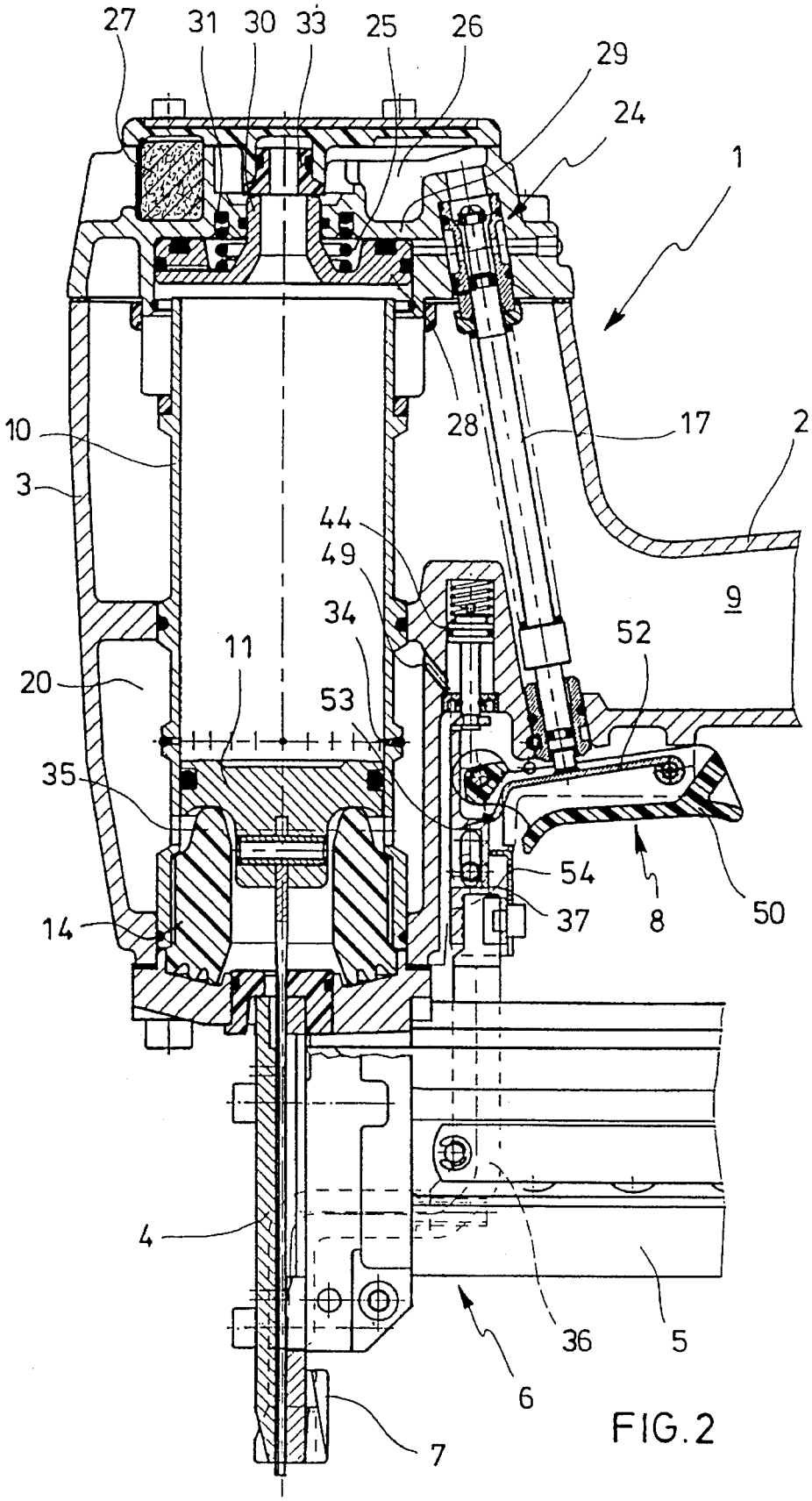
FIG. 2 the same tool during the working stroke of the working piston in the same sectional view.
Figure 3:
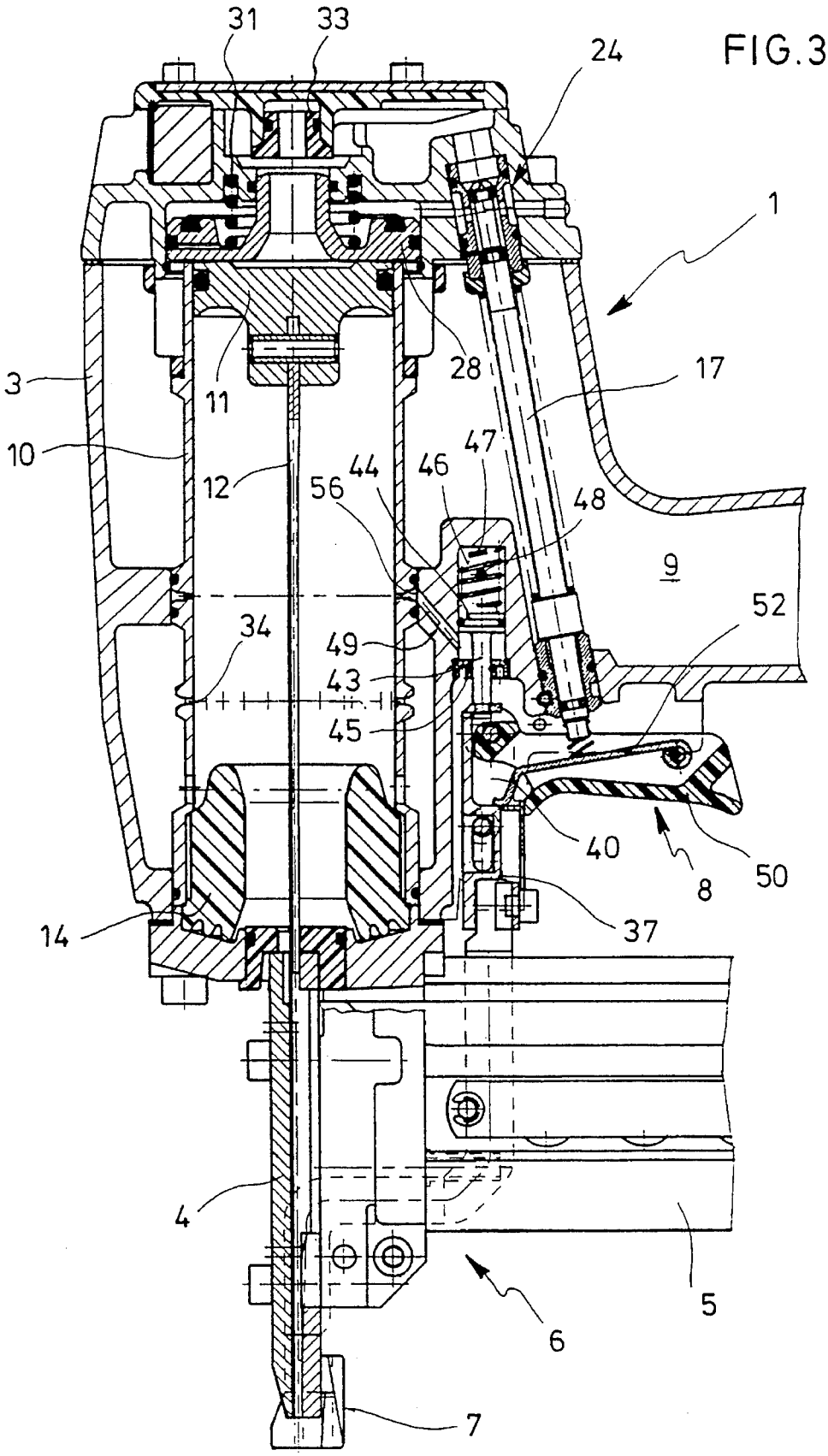
FIG. 3 a driving tool with locking air from a third opening of the working cylinder in rest position and in longitudinal section across the front area.
Figure 4:
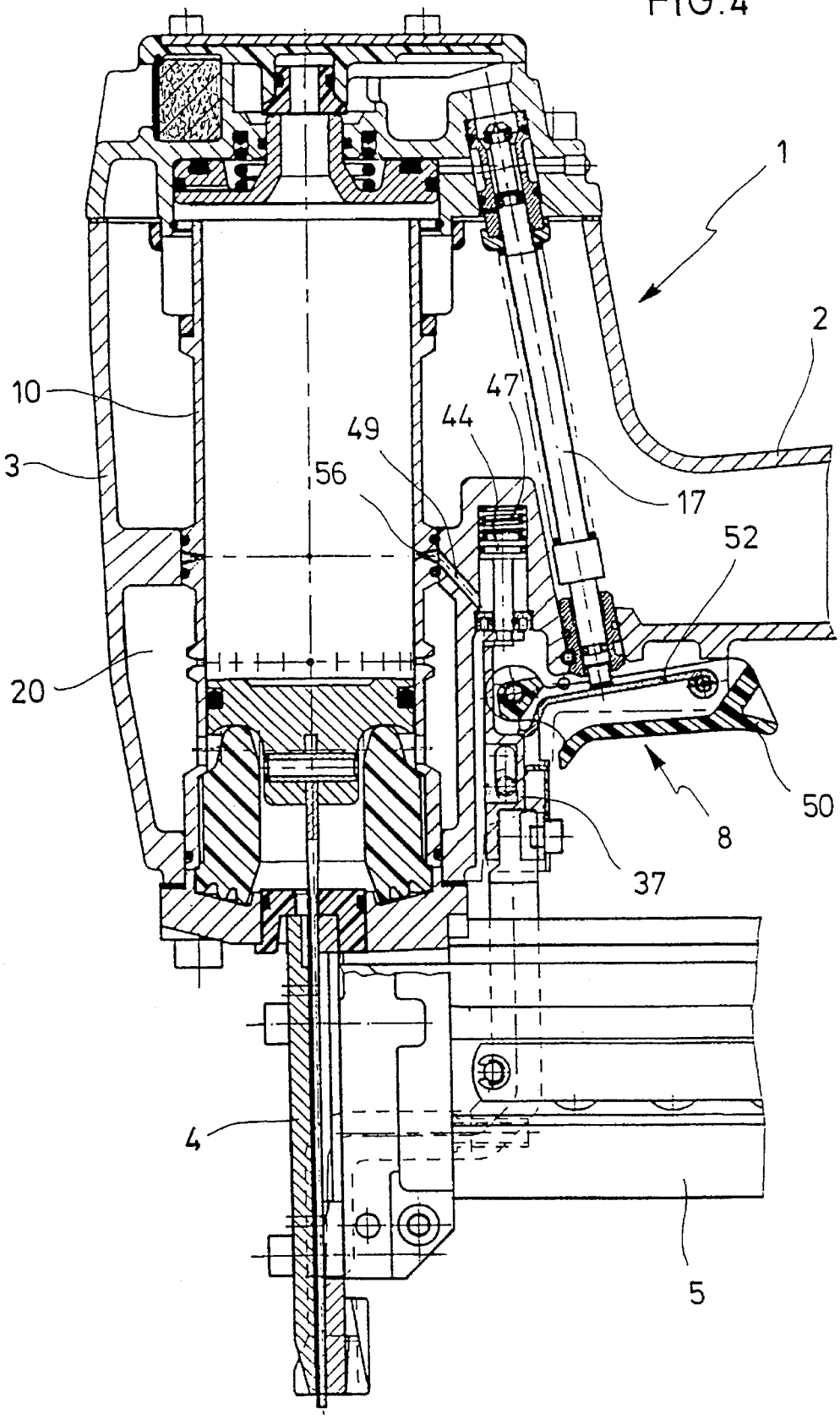
FIG. 4 the same tool during the working stroke of the working piston in the same section.
Figure 5:
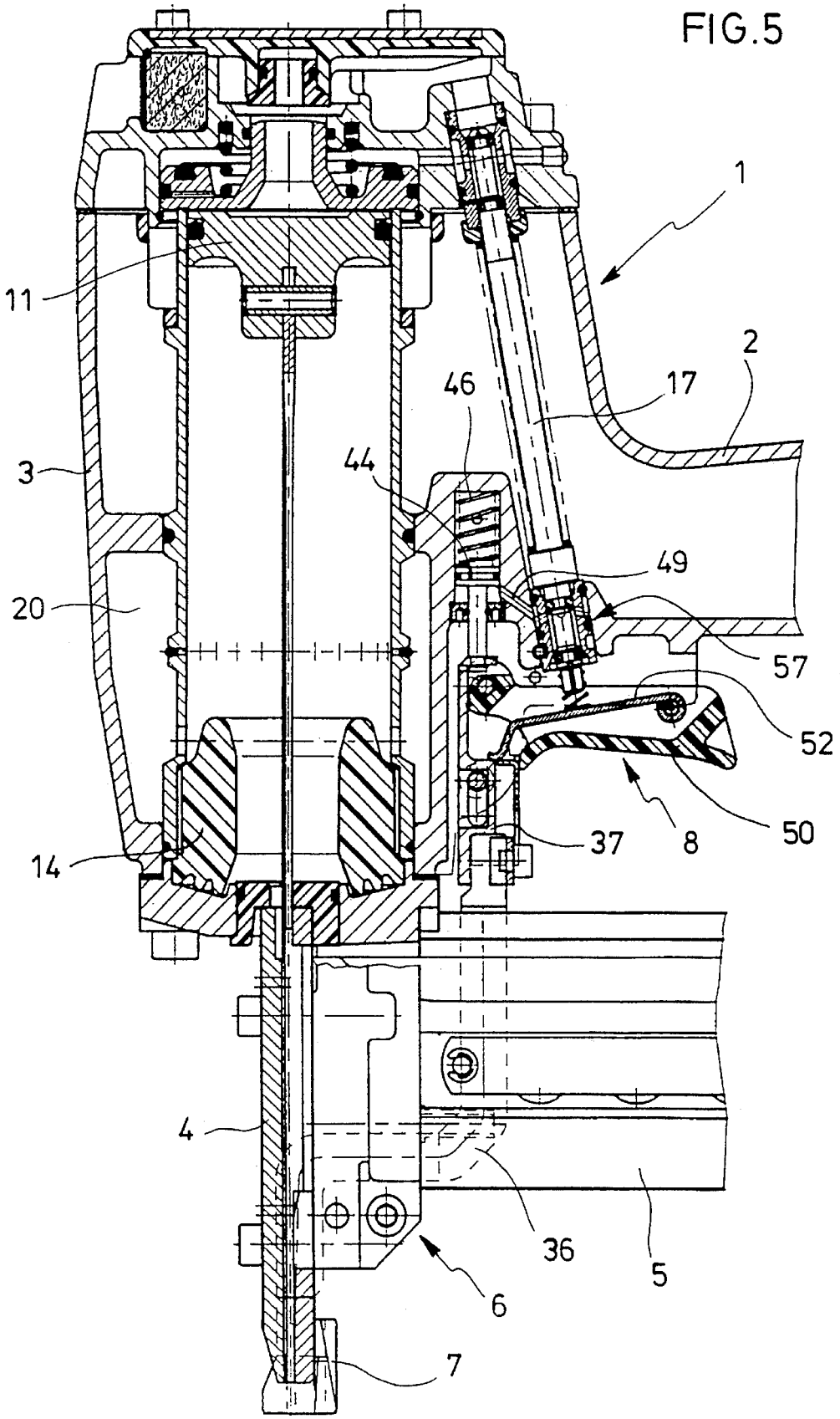
FIG. 5 driving tool with locking air from an auxiliary valve on the valve rod in rest position and in longitudinal section across the front area.
Figure 7:
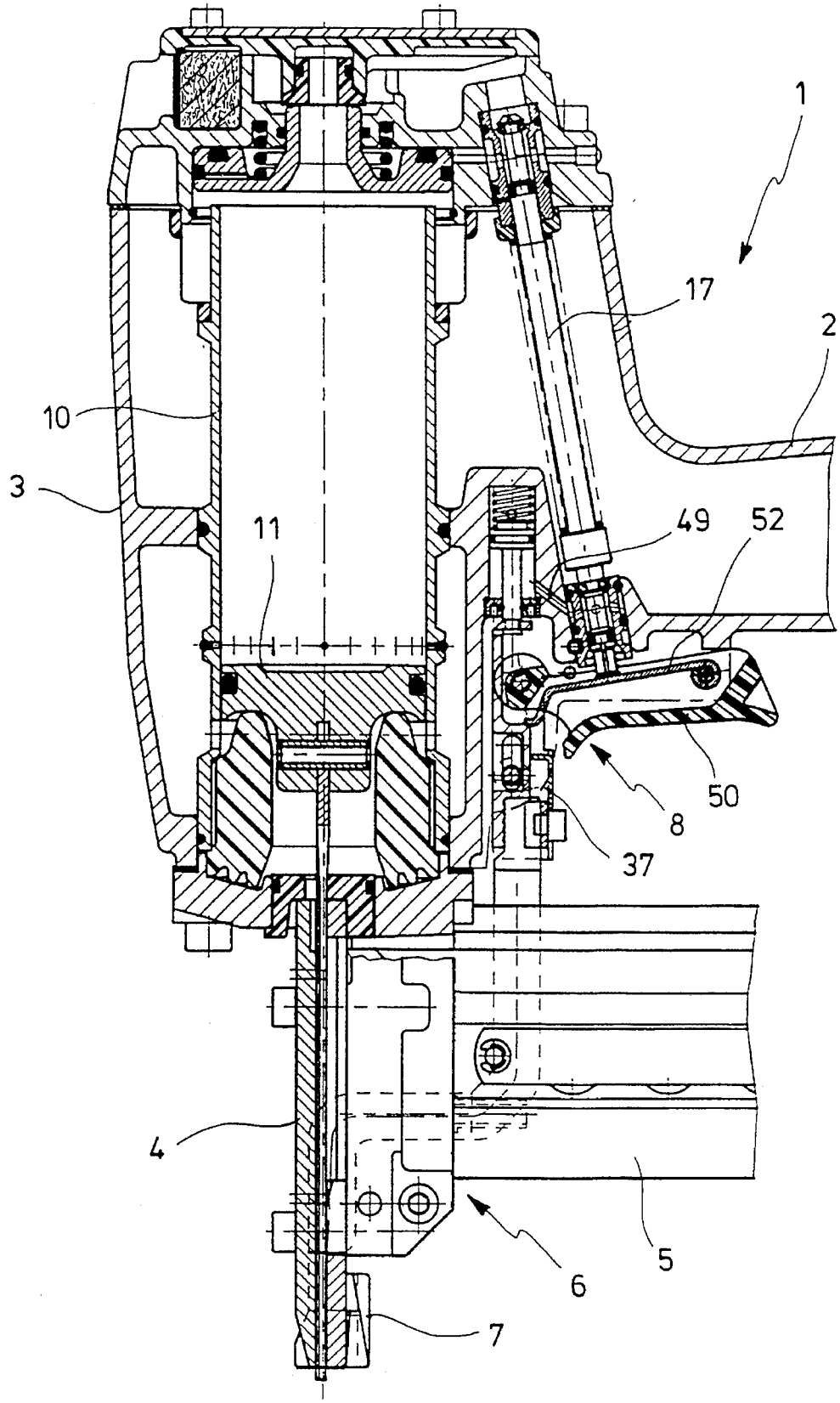
FIG. 7 the same tool during the working stroke of the working piston in a longitudinal section across the front area.
Figure 8:
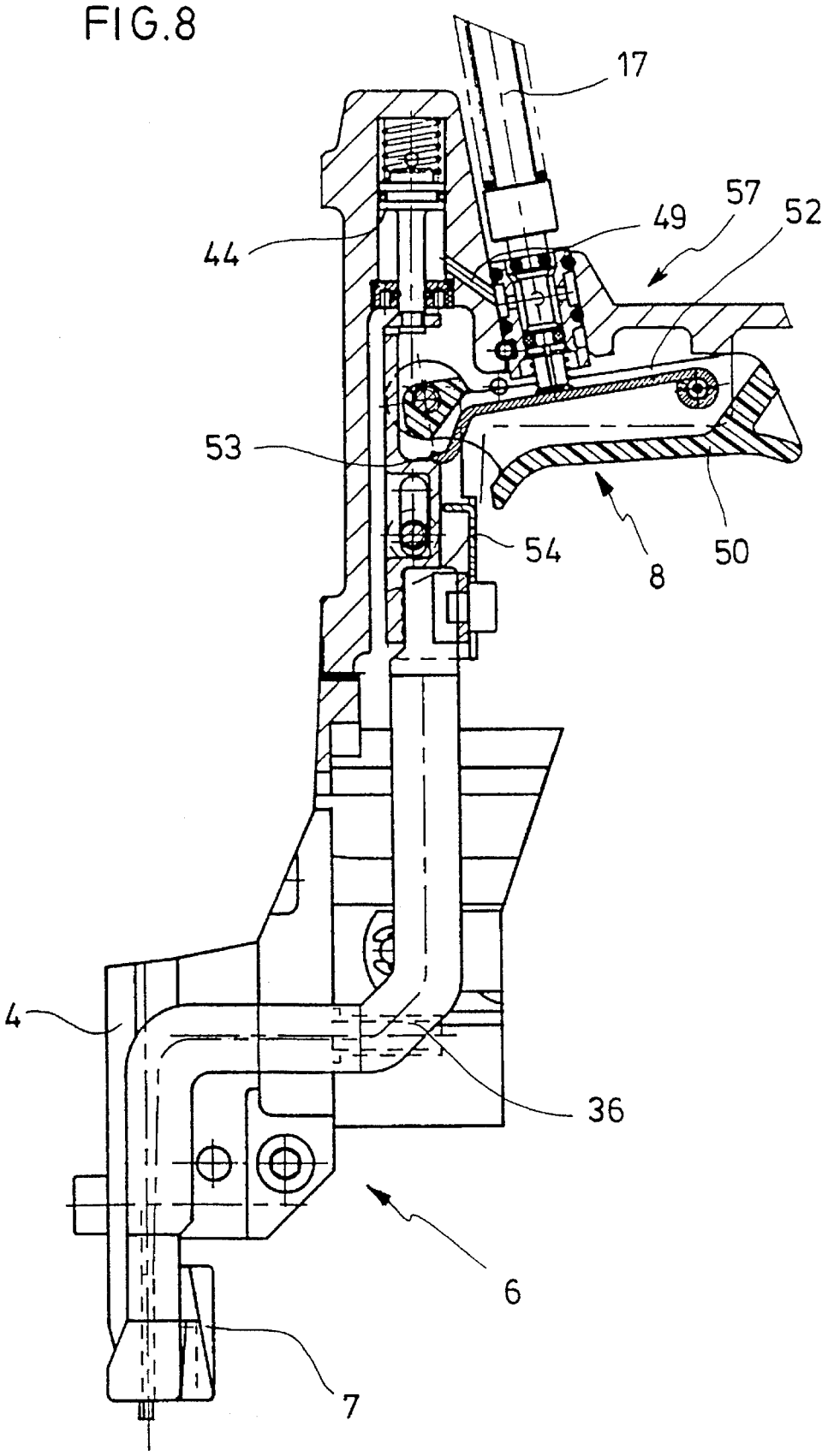
FIG. 8 sensing means and trigger lever according to FIG. 7 in an enlarged partial section.

Before actuation of the valve rod 17 the working pressure imparted to the upper side of the control piston 28 through the auxiliary valve 24 together with an eventual pretension of the coil spring 31, causes the valve piston against a working pressure acting upon its outer edge circumference from below being sealingly pressed with its lower edge against the upper edge of the working cylinder 10 (FIGS. 1, 3 and 5). An actuation of the valve rod 17, however, results in an aeration of the upper side of the control piston 28 so that the working pressure acting from below moves it to an upper position where it sealingly engages the upper case wall 29 and with its nose 30 sealingly engages the valve seat element 33. The space of the working cylinder above the piston 11 then is no longer connected to atmosphere via the air outlet space 26 so that compressed air from the compressed-air storage space 9 drives the piston to the brake ring 14 (FIGS. 2, 4, 7).

For driving the working piston 11 to the lower dead center the piston return chamber 20 is filled with compressed pressed air via a second opening 34 of the working cylinder 10 at a distance from the lower dead center. The piston return chamber 20 is in contact with the bottom side of the working piston 11 via a first opening 35 adjacent to the lower dead center.

The air in the piston return chamber 20 can drive the working piston 11 from its lower into the upper dead center position only after the working cylinder 10 above is again separated from the compressed-air storage space 9 and is aerated. For this purpose, the valve rod 17 is to be released to enable it to return into its rest position, with the collar 19 being in engagement with the leadthrough 22. In that case the compressed-air storage space 9 is connected with the upper side of the control piston 28 via the auxiliary valve 24. Together with the force of the tensioned coil spring 31 the upper-surface pressure against the working pressure acting below causes the working piston 28 to return into its rest position (FIGS. 1, 3, 5). Thereat the valve seat element 33 follows the movement of the tubular nose 30 until it is stopped by the upper edge of the upper case wall 29. In this way, any compressed-air losses caused by compressed air escaped through the nose 30 and the air outlet space 26 are avoided. If, however, the control piston 28 sealingly engages the upper edge of the working cylinder 10, residual air may escape through nose 30 and the air outlet space 26 causing the valve seat element 33 to return into its upper rest position.

Moreover, all embodiments illustrated in the drawings have in common that proceeding from the sensor head 7 the sensing means 6 comprise a bow 36 which is led to a sensor slide port ion 37. The sensor slide portion 37 includes a longitudinal slot 38 which is guided on bolt 39 connected to the casing. The sensor slide portion 37 comprises a c-shaped recess 40 above, the lower limiting portion of which forms an abutment portion 41. An upper limiting portion 42 of the recess 40 is tightly connected to a shaft 43 of a locking piston 44. The piston shaft 43 is led through a case sealing 45. The locking piston 44 is sealingly guided within a locking cylinder 46. In the locking cylinder 46 the piston 44 is supported by a coil spring 47. The locking cylinder 46 comprises a vent bore 48. On the other side of the piston a control line 49 ends in the locking cylinder 46.

The trigger means 8 includes a valve lever 50 which in the recess 40 of the sensor slide portion 37 comprises a pivot pin 51. A control lever 52 is located adjacent to the free end of the valve lever 50 the control lever 52 extends in the direction opposite to the valve lever 50 and comprises a short free control lever end 53 bent at right angle. In all of the drawings the free control lever end 53 engages the abutment portion 41 of the sensor slide portion 37.

Adjacent to the sensor slide portion 37 a supporting portion 54 in the form of a horizontally angled sheet metal is arranged.

The supporting portion 54 is in alignment with the abutment portion 41 with the sensor means 7 being unactuated.

Between the control lever 52 and the lower end of the valve rod 17 a coil spring 55 is supported.

According to the embodiment of FIGS. 1 and 2, the control line 49 is directly connected to the piston return chamber 20. According to the embodiment shown in FIGS. 3 and 4, the control line 49 is led to a third bore 56 of the working cylinder 10, with the distance to the brake ring 14 being larger than that of the bore 34.

As for the version according to FIG. 5 to 8, the control valve 49 is led to another auxiliary valve 57 which is arranged at the lower end of the valve rod 17.

Figure 6:
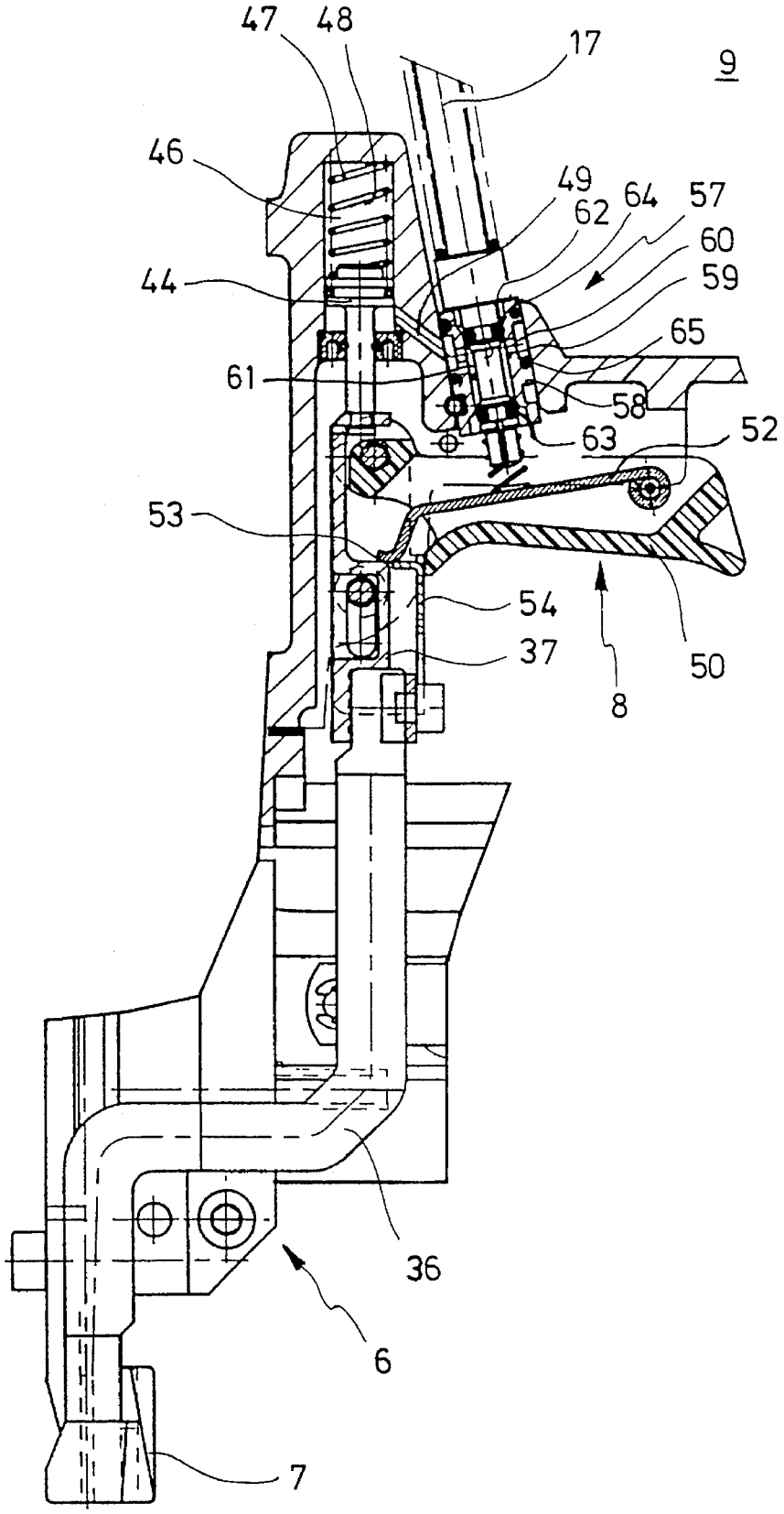
FIG. 6 sensing means and trigger lever of the same tool in an enlarged partial section.

According to FIG. 6, the auxiliary valve 57 comprises a sleeve 58, an annular channel 59 being provided between the sleeve and case 1, in which annular channel the control line 49 ends. Via bores 60 the annular channel 59 is connected to an annular gap 61 which is formed between a tapered portion of the valve rod 17 and the sleeve 58. On the valve rod portion O-rings 62, 63 are provided, one of which is sealingly engaging an associated sealing portion of sleeve 58 each time. On the outside the sleeve 58 is sealed by means of further O-rings 64, 65 on both sides of the annular channel 59 opposite to case 1.

Thus, with the valve rod 17 being unactuated, the control line 49 is connected to the atmosphere via the auxiliary valve 57. With the valve rod 17 being actuated, the latter is displaced upwardly causing the control line 49 to connect to the compressed-air storage space 9.

All of the illustrated embodiments of the tool do not allow a triggering of the drive-in operation by actuation of the valve lever 50 unless the sensing means 6 with its sensor head 7 is placed upon a workpiece. If, namely, the sensor head 7 is not moved upwardly, the sensor slide portion 37 keeps its lowest position according to, FIGS. 1, 3 and 5 causing the control lever 52 with its free control lever end 53 to slip from the abutment portion 41 to the supporting portion 54 when pivotally moving the valve lever 50 upwardly. The pivoting way of the valve lever 50 then is not long enough to press the control lever 52 against the valve rod 17 from below and to actuate it.

If, however, the mouth tool 4 is first placed upon a workpiece, with the sensor head 7 being displaced when lying level with the outlet 15, the free control lever end 53 is also moved slightly upwardly on condition that the control lever 52 is engaging the abutment portion 41 when starting actuation of the sensing means 6. A subsequent actuation of the trigger lever 8 forces the control lever 52 against the lower end of the valve rod 17 in order to trigger the above-described working stroke of the working piston 11. Thereat, by means of the respective control lines 49, the locking piston 44 is loaded to such an extent that the sensor slide portion is maintained in its upper position. According to FIG. 2, this is achieved by the pressure in the piston return chamber 20 which is built up during the working stroke. According to FIG. 4, the locking goes into effect before by the pressure in the working cylinder 10. According to FIGS. 7 and 8, directly following the actuation of the valve rod 17, the second auxiliary valve 57 causes the build-up of the pressure on the locking piston 44.

The locking is maintained as long as the trigger lever 8 is actuated after locking the sensing means 6. Only after releasing the trigger lever 8 the reset spring 21 causes the valve rod 17 to return to its rest position while the piston 11 moves towards its upper dead center in the above-described way. Then the pressure in the piston return chamber 20 resp. the working cylinder 10 drops below the piston 11 and the second auxiliary valve 57 is connected to atmosphere again. Consequently, the pressure below the locking piston 44 drops to an atmospheric level and the locking of the sensing means 6 is no longer maintained. Then the latter is forced back to its rest position by means of the coil spring 47.

In case, as a result of the return stroke, the tool suddenly moves upwards during the drive-in operation, the locking of the sensing means 6 prevents the control lever 52 from slipping from the abutment portion 41 and from not releasing the valve rod 17 when actuating the trigger lever 8 subsequently. Furthermore, with the tool according to the invention, it is achieved that, in case the tool suddenly moves upwards with the trigger lever 8 being actuated, there is nothing against a further individual triggering after placing the sensor head upon the workpiece again.

I claim:

1. A pneumatically operated driving tool, comprising a working cylinder (10) with a working piston (11) being movable between an upper and a lower dead center, a drive-in tappet (12) mounted on said working piston, a control valve array (18), which, when actuating a valve rod (17), connects a working stroke space above said working piston to compressed air for moving said piston to the lower dead center and, when releasing said valve rod, connects the working stroke space to atmosphere for moving said piston to the upper dead center, a piston return chamber (20) surrounding said working cylinder, said piston return chamber being connected to said working cylinder via a first opening (35) adjacent to the lower dead center and via a second opening (34) spaced apart from the lower dead center, a mouth tool (4) comprising a drive-in channel (13) guiding said drive-in tappet, an outlet and a moving area for the drive-in tappet, a magazine (5) for fasteners having an opening, said magazine opening being adjacent to the moving area of said drive-in tappet, a sensing means (6) comprising a sensor head (7) which extends below the outlet (15) of said mouth tool and is axially slidably movable and a sensor slide portion (37) connected to the sensor head and an abutment portion (41), which extends transversely to the sensor slide portion's direction of displacement, the pneumatically operated driving tool further comprising a trigger lever (8) for displacing said valve rod (17) comprising a pivotally mounted valve lever (50) having a free end and a pivotally mounted end and a control lever (52) mounted thereon and facing said valve rod, said control lever (52) being pivotally mounted adjacent to the free end of said valve lever and having a free control lever end (53) adjacent to the pivotally mounted end of said valve lever, wherein said free control lever end is supported by said abutment portion (41) before displacement of the sensor head, whereby displacing said sensor head (7) by placing the tool upon a workpiece the sensing means is actuated, prior to actuating said trigger lever (8), which is accomplished by pivoting said valve lever (50) towards said valve rod (17), said free control lever end remains supported by said abutment portion (41) when first actuating said sensing means (6) thereafter, when actuating said trigger lever (8) so that said control lever (52) actuates said valve rod (17), said free control lever end slips from said abutment portion (41) so that when actuating said trigger lever (8) after the initial trigger lever actuation without first actuating said sensing means (6), said valve rod (17) is not being further displaced by said control lever (52), the operating tool further comprising a locking means (44, 46) being associated to said sensing means (6), wherein said sensor slide portion (37) is connected to a movable locking piston (44) within a locking cylinder (46), wherein said locking piston (44) is loaded with working pressure forcing the locking piston in the direction in which the sensor slide portion (37) is actuated for locking and is aerated for unlocking, the sensing means being locked by the locking means in the sensing means' operated position in response to actuating said valve rod (17) and unlocks said sensing means when releasing said valve rod.

2. The pneumatically operated driving tool according to claim 1, further comprising a control line (49) wherein the control line is connected to said piston return chamber (20) and the locking cylinder for loading said locking piston.

3. The pneumatically operated driving tool according to claim 1, further comprising a control line (49), the control line being connected to said working cylinder (10) via a third opening (56) and the locking cylinder for loading said locking piston, wherein the third opening is further from the lower dead center than the second opening (34).

4. The pneumatically operated driving tool according to claim 1, further comprising a control line (49) for loading said locking piston, said control line (49) being connected to an auxiliary valve (57) on said valve rod (17).

5. The pneumatically operated driving tool according to claim 1, further comprising a pressure spring (47) which acts upon said locking cylinder (46) in the opposite direction of actuation of said sensor slide portion (37).

6. The pneumatically operated driving tool according to claim 1, wherein said sensor slide portion (37) comprises a recess (40) being c-shaped in cross-section and having a lower limitation and an upper limitation, wherein the lower limitation forms the abutment portion (41) for the free control lever end (53) and the upper limitation is connected to said locking piston (44).

7. The pneumatically operated driving tool according to claim 6, further comprising a pivot pin connected to the valve lever, wherein said recess (40) receives the pivot pin (51) of said valve lever (50).

8. The pneumatically operated driving tool according to claim 1, further comprising a fixed supporting portion (54) positioned adjacent to said sensor slide portion (37) and fixed to said tool body for said free control lever end (53) wherein the fixed supporting portion is in alignment with said abutment portion (41) before actuation of said sensing means (6).

9. The pneumatically operated driving tool according to claim 1, further comprising a pressure spring (55) positioned between said control lever (52) and said valve rod (17).

10. The pneumatically operated driving tool according to claim 1, wherein said control valve array (18) controls said loading and aerating of said locking piston (44).

* * * * *